US005984172A

United States Patent [19]

Easterwood

[11] Patent Number: 5,984,172

[45] Date of Patent: Nov. 16, 1999

[54] FREESTANDING MAILBOX COVER

[76] Inventor: Rodney T. Easterwood, 6912 Georgia, Kansas City, Kans. 66109

[21] Appl. No.: 09/049,614

[22] Filed: Mar. 27, 1998

[51] Int. Cl.[6] ..... B65D 91/00

[52] U.S. Cl. ..... 232/38; 232/17; 150/154; 52/3

[58] Field of Search ..... 232/38, 17, 45; 150/154, 158, 165; D99/29, 30, 31, 32, 33; 52/3

[56] References Cited

U.S. PATENT DOCUMENTS

| | | | |
|---|---|---|---|
| D. 359,987 | 7/1995 | Yoshikawa . | |
| 1,340,863 | 5/1920 | Knight . | |
| 3,168,209 | 2/1965 | Brookins et al. . | |
| 3,785,451 | 1/1974 | McCord . | |
| 4,721,140 | 1/1988 | Coker . | |
| 4,954,384 | 9/1990 | Hartwell . | |
| 4,991,769 | 2/1991 | Todd | 232/38 X |
| 5,106,016 | 4/1992 | Beckman | 232/38 X |
| 5,192,092 | 3/1993 | DiBenedetto . | |
| 5,372,414 | 12/1994 | Lamonakis et al. . | |
| 5,720,312 | 2/1998 | Scheuermann . | |

*Primary Examiner*—Terry Lee Melius
*Assistant Examiner*—William L. Miller
*Attorney, Agent, or Firm*—Hovey, Williams, Timmons & Collins

[57] ABSTRACT

An ornamental and protective cover for a freestanding mailbox is provided which includes a sheet presenting a pair of opposed sides, a front panel presenting a passage for mail to be inserted into the mailbox, and a rear panel, the front and rear panels being connected to and interconnecting the sides. The sides and front and rear panels preferably extend downwardly a common length to their respective bottom margins to enclose a region therein. The cover may be provided with decorative and informative indicia. Moreover, the cover, which is preferably of flexible synthetic resin material, may be opaque, transparent or translucent, with cut out openings and windows of transparent material provided over the openings. A light fixture or audio source may be provided within the enclosed region. The cover may be retained in position over the freestanding mailbox by weights attached adjacent the bottom margin or the use of a drawstring to pull the bottom margin of the sides of the cover together.

12 Claims, 1 Drawing Sheet

FREESTANDING MAILBOX COVER

BACKGROUND OF THE INVENTION

1. Field of the Invention

This invention relates to a freestanding mailbox cover which is designed to drape over a streetside mailbox without inhibiting functionality. More particularly, it is concerned with a mailbox cover which aids in protecting a mailbox from the elements and provides a base for receiving ornamental indicia thereon.

2. Description of the Prior Art

Freestanding mailboxes, as used herein, are of the type long used in rural areas and more frequently in suburban locations which are positioned adjacent a street or road and are elevated on a post or the like to permit mail delivery from a vehicle. The mailbox commonly includes a door which may be opened to place mail within the mailbox and a flag which may be raised to signal the mailman that outgoing mail is contained in the mailbox. While the mailbox, door and flag vary as to shape and location, a typical mailbox positioned on a roadside post includes a rounded upper surface, a hinged door pivotal from the bottom, and a flag pivotally mounted on one side of the box.

While many people have decorated their mailboxes, these efforts have primarily concentrated on permanent presentations such as painting the box, adding ornaments, or using different types of posts or other supports. Seasonal decorations have been largely limited in character to garlands or other discrete decorations. While many of these decorative efforts have been unique, eye-catching and attractive, they have failed to cover and protect the mailbox inside. Moreover, they have been relatively expensive and difficult to affix. Furthermore, such ornaments have little capability for providing a display of indicia thereon, and have not decorated the area including both the post and the mailbox itself.

SUMMARY OF THE INVENTION

These objects are largely met by the freestanding mailbox cover hereof. That is to say, the mailbox cover hereof is relatively inexpensive, permitting the creation or purchase of several different covers for alternative occasions, is easy to use and remove, can be used with a variety of different mailboxes, provides a background for the display of readily visible indicia thereon, and decorates both the mailbox and post with a single article.

In greater detail, the freestanding mailbox cover hereof broadly includes a U-shaped sheet of flexible material presenting two sides and a bottom opening, and a front panel and a back panel connecting the two sides. An opening is presented above the front panel for permitting operation of the mailbox door. Another opening may be cut by the user to coincide with the position of the mailbox flag. The sheet and panels are preferably provided of a sturdy, flexible, synthetic resin material which may be stitched, bonded, or welded together, and may be opaque, translucent or transparent. Advantageously, indicia are placed on the outer surface of the sheet to signify a particular season, the address of the owner, a birthday or other occasion. In particularly preferred embodiments, a lighting fixture may be affixed to the post and openings or transparent portions provided in the sheet, whereby the cover protects and shields not only the mailbox but the lighting fixture beneath the cover. A sound generating device such as a remote speaker or playback machine may be placed within the cover to provide an audible message, for example music or mysterious sounds for Halloween. The back panel may be provided with hook and loop closure material and bifurcated to facilitate conformation to a variety of different freestanding mailboxes. The bottom portions of the sheet and panels (when they extend downwardly to the extent of the sheet) may be weighted, or gathered and provided with a drawstring to hold the cover in place against the force of wind.

These and other benefits will be readily appreciated by those skilled in the art with reference to the following description and drawing figures of the preferred embodiments.

DESCRIPTION OF THE PREFERRED EMBODIMENT

Figures 1, 2, 3:
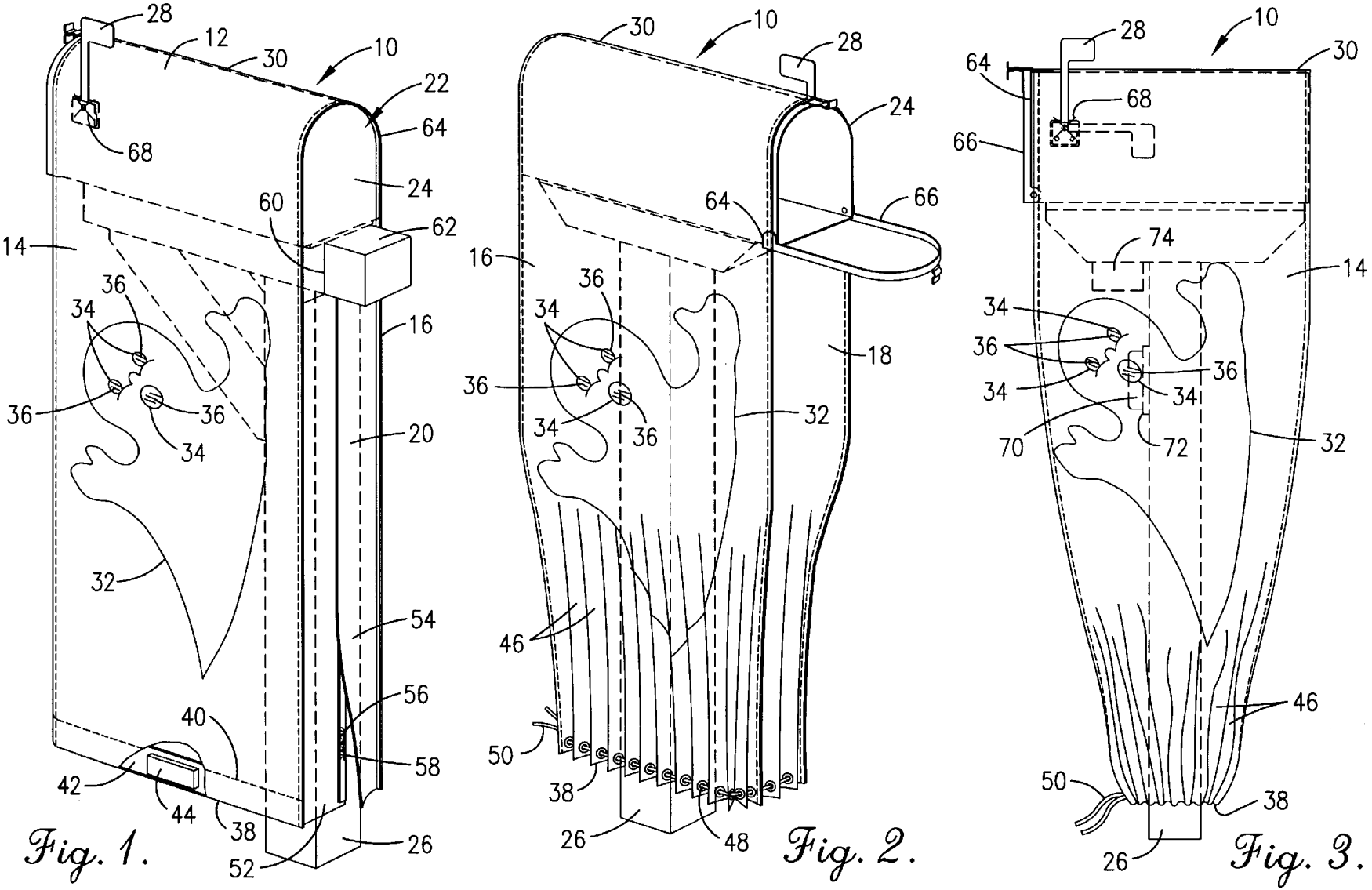
FIG. 1 is a right rear perspective view of a first embodiment of a freestanding mailbox cover in accordance with the present invention, showing thus use of a bifurcated back panel and a weighted bottom margin along the sides of the sheet.
FIG. 2 is a left front perspective view of a second embodiment of the freestanding mailbox cover hereof, showing the lower portion of the front panel and sides gathered to accommodate a drawstring closure along the bottom margin.
FIG. 3 is a right side elevational view of the freestanding mailbox cover shown in FIG. 2, illustrating a cut location along the right side of the cover to accommodate the mailbox flag and showing the use of transparent panels in the indicia on the outside of the cover to accommodate the passage of light from the lighting fixture attached to the post therethrough.

Referring now to the drawings, a first embodiment of the freestanding mailbox cover 10 hereof broadly includes a sheet 12 presenting a first side 14 and a opposite second side 16, and a front panel 18 and a back panel 20 interconnecting the first and second sides. The cover 10 is configured to drape over a freestanding mailbox 22, which includes a box 24 and a support post 26. The configuration of the post 26 or its material of construction is incidental to the present invention inasmuch as its primary purpose is to elevate the box 24 to permit the insertion of mail therein. In that regard, the post may be wood, metal pipe or wrought iron, masonry or other material. The box 24 carries a flag 28, which is shown positioned on the right side of the box 24, but in practice may also be placed on top of the box or elsewhere when permitted by postal regulations.

In greater detail, the sheet 12 may be unitary or the sides 16 and 18 may be separately provided and joined by sewing, welding, or bonding at a top 30 of the sheet 12 to present a seam. The sheet 12 and panels 18 and 20 are preferably of sturdy, flexible, synthetic resin material, which may be transparent, translucent or opaque. A particularly useful material is eight mil (0.008 inch) polyvinyl chloride, which may be sewn together and is resistant to tearing while remaining lightweight and flexible. Indicia 32 may be painted or applied to the outer surface of the sheet 12 to provide a decorative image. In the preferred embodiments illustrated herein, the indicia 32 is shown with cutout holes 34 in the sheet 12, with transparent synthetic resin windows 36 glued, bonded or otherwise secured to cover the cut-out holes 34 to permit the passage of light therethrough but keep the region within the cover 10 enclosed. In the embodiment shown in FIG. 1, the bottom margin 38 of the sides 14 and 16 provided with a hem 40 formed by turning the side upwardly to form a pocket 42 and sewing the hem along a seam line 44. A weight 44 of lead or the like is preferably place in the pocket 42 to assist in retaining the cover 10 on the freestanding mailbox 22 during windy conditions. Alternatively, in the embodiments shown in FIGS. 2 and 3, the area of the sides 14 and 16 and front and back panels 18 and 20 above the bottom margin is gathered to form pleats 46. Grommets 48 or other equivalent reinforcements providing holes therein may be provided adjacent the bottom margin 38 and a drawstring 50 is passed through the grommets to hold the cover 10 in position. Alternatively, the drawstring 50 may be passed through the pocket 42 fabricated as described above as shown in FIG. 3.

As shown in FIG. 1, back panel 20 of flexible synthetic resin material may be provided as first flap 52 and second flap 54 of overlapping length. The back panel 20 need not, but preferably does, extend downwardly as far as bottom margin 38 of each of the sides 14 and 16. When presented in overlapping flaps 52 and 54, the back panel 20 is preferably provided with releasable closures 56 at desired height intervals. In FIG. 1, hook and loop closures 58, commonly sold under the trademark VELCRO® are shown, but other releasable closures such as buttons, snaps or adhesive tape could be used as well. Further, an opening 60 may be provided in the back panel 20 to receive therethrough the rear extension of a crossbeam 62 of the post 26, but keeping the remainder of the rear of the post 26 and the box 24 covered.

The front panel 18 may be of any desired length but in any event presents a passage 64 at the front margin of the sheet 12 and the top of the front panel 18 so that the front panel 18 does not extend over the front of the box 24, thereby permitting free opening of the door 66 of the box 24, as illustrated in FIG. 2. Preferably, the front panel 16 will extend vertically downwardly from the passage 64 to enclose the region between the bottom of the door 66 and the bottom margin 38 of the sides 14 and 16. The front panel 18 and the rear panel 20 are preferably secured by sewing, as illustrated, or alternatively welded, or adhesively bonded at their side edges to sheet 12.

Because the location of the flag 28 will be different on different mailboxes, the end user may cut through the sheet 12 at the desired location to accommodate the flag 28 therethrough during placement of the cover 10. However, a pre-positioned weakened area 68 provided by perforation, scoring or die-cutting may be provided at the typical flag location to permit easy installation. If desired, a backing may be provided within the sheet 12 to inhibit tearing.

In particularly preferred embodiments, a battery-operated light fixture 70 may be provided in the region enclosed by the cover 10. The light fixture 70 is preferably provided with structure such as a mounting flange 72 for attachment to the post 26 to provide a source of illumination within the cover 10 which provides a dramatic effect through a translucent material and also through the cut-out holes 34 and windows 36. Furthermore, an audio source 74, such as a remote speaker, tape player or radio may be placed within the box 24 or mounted to the post 26 by structure such as adhesive tape, nails or the like to provide an audible message. Such combination of audible and visual sources not only enhances the decorative presentation of the cover 10, but the performance of the audible and visual sources benefits from the protection provided by the cover 10 and the combination of translucency and transparency which hides the audio source 74 and diffuses the light from the light fixture 70.

In order to use the cover 10, the light fixture 70 and audio source 74, if desired, are first attached to the post 26 by nailing, brackets, adhesive tape or other suitable means. The cover 10 is then simply draped over the top of the box 24, and a cut is made in the sheet 12 along the top or one of the sides such as through cut lines in weakened area 68 to accommodate the flag 28. The cover 10 is aligned so that the top of the box 24 is covered but the passage 64 is positioned in front of the door 66 so that the latter freely pivots down to receive mail and latches when in the up position. When the post 26 is of the type shown in FIG. 1, the rear extension of crossbeam 62 is placed through opening 60 and the flaps 52 and 54 are overlapped and secured by using hook and loop closures 58, and the weights help hold the cover 10 in place. Alternatively, when the embodiment of the cover 10 shown in FIGS. 2 and 3 is used, the cover 10 is draped over the mailbox 22 and the drawstring 50 is pulled and tied. This permits the user to return when desired to switch on the light fixture 70 and the audio source 74 for information or amusement purposes, or when the indicia or cut-out holes 34 and/or windows 36 are provided with the name or address of the user, to guide guests to the proper residence. The use of coordinated audio messages and indicia enhance special occasions such as holidays (Christmas, Halloween, etc.), birthdays, team member recognitions before important games, or other special events.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any article or apparatus not materially departing from but outside the literal scope of the invention as set out in the following claims.

What is claimed is:

1. In combination:

a mailbox including a box having a door for permitting the passage of mail into the box, a flag shiftably mounted on the box for signaling the presence of outgoing mail therein, and a post connected to said box for elevating the box; and a cover supported by said mailbox, said cover including:

a substantially U-shaped sheet of flexible material presenting a top and two opposing downwardly extending sides each having a bottom margin;

a front panel of flexible material connecting said sides and positioned below said top to present a mail-receiving passage therebetween, said passage being aligned with said door; and a back panel of flexible material connecting said sides.

2. The combination of claim 1, said cover including a line of weakening for receiving said flag therethrough.

3. The combination of claim 1, at least one of said sides presenting a hole therein.

4. The combination of claim 1, said cover including indicia on at least one of said sides.

5. The combination of claim 1, said front panel of said cover extending vertically downward from said passage to a position substantially horizontally aligned with said bottom margin of said sides, said back panel presenting a bottom edge substantially horizontally aligned with said bottom margin of said sides to thereby define an enclosed region.

6. The combination of claim 5, including a light fixture connected to said mailbox and positioned within said enclosed region.

7. The combination of claim 5, said back panel presenting a pair of flaps, each of said flaps being connected to a respective one of said sides and including a closure for releasably interconnecting said flaps.

8. The combination of claim 5, including a weight connected to said sheet adjacent said bottom margin of at least one of said sides.

9. The combination of claim 5, said sheet being formed to present a plurality of pleats adjacent said bottom margin and further including a drawstring connected to said sheet adjacent the bottom margin of each of said sides.

10. The combination of claim 5, including an audio source connected to said mailbox and positioned within said cover.

11. The combination of claim 1, wherein said back panel extends only a portion of the distance between said bottom margin and said top.

12. The combination of claim 1, wherein said sheet, front panel and back panel are of synthetic resin material.

* * * * *